US007338302B2

(12) United States Patent
Thiele et al.

(10) Patent No.: US 7,338,302 B2
(45) Date of Patent: Mar. 4, 2008

(54) SEALED LAMP SOCKET

(75) Inventors: Jürgen Thiele, Kierspe (DE); Hans-Peter Mews, Lüdenscheid (DE)

(73) Assignee: Vossloh-Schwabe Deutschland GmbH, Lüdenscheid (DE)

( * ) Notice: Subject to any disclaimer, the term of this patent is extended or adjusted under 35 U.S.C. 154(b) by 0 days.

(21) Appl. No.: 11/599,979

(22) Filed: Nov. 15, 2006

(65) Prior Publication Data

US 2007/0117466 A1 May 24, 2007

(30) Foreign Application Priority Data

Nov. 24, 2005 (DE) ..... 10 2005 056 022.9

(51) Int. Cl.
*H01R 33/02* (2006.01)

(52) U.S. Cl. ..... 439/230; 439/232

(58) Field of Classification Search ..... 439/230, 439/232, 233, 271, 272, 277, 280, 320
See application file for complete search history.

(56) References Cited

U.S. PATENT DOCUMENTS

| | | | | |
|---|---|---|---|---|
| 2,683,257 | A * | 7/1954 | Gasser-Steiner | 439/230 |
| 2,732,530 | A * | 1/1956 | Dahlhaus et al. | 439/230 |
| 4,936,789 | A * | 6/1990 | Ugalde | 439/236 |
| 5,029,056 | A * | 7/1991 | Patterson, Jr. | 362/645 |
| 5,165,867 | A * | 11/1992 | Dockery | 417/360 |
| 5,634,808 | A * | 6/1997 | Shinji | 439/277 |
| 5,743,758 | A * | 4/1998 | Cheng et al. | 439/419 |
| 5,785,544 | A * | 7/1998 | Linden et al. | 439/278 |
| 5,879,179 | A * | 3/1999 | Fukuda | 439/271 |
| 5,906,499 | A * | 5/1999 | Sikora et al. | 439/271 |
| 6,039,592 | A * | 3/2000 | Shinchi | 439/271 |
| 6,680,575 | B1 | 1/2004 | Ushio | |

FOREIGN PATENT DOCUMENTS

| | | |
|---|---|---|
| CH | 275 959 A | 6/1951 |
| CH | 275 959 A | 9/1951 |
| DE | 830 538 C | 2/1952 |
| DE | 1 640 348 U | 7/1952 |
| DE | 1 004 734 B | 3/1957 |
| DE | 1 004 743 A | 3/1957 |
| DE | 1 802 296 U | 12/1959 |
| DE | 83 10 312.0 U1 | 7/1983 |
| DE | 83 10 312 U1 | 7/1983 |
| DE | 94 05 817 U1 | 7/1994 |

* cited by examiner

*Primary Examiner*—Thanh-Tam Le
(74) *Attorney, Agent, or Firm*—R. S. Lombard

(57) ABSTRACT

A novel lamp socket finding application with a type of increased protection, has a housing part (13) in which a one-piece elastomer sealing sleeve (20) is preferably rotatably held. The sealing sleeve (20) is at its lamp-side end preferably slightly radially compressible, while it is stiffer in the axial direction. As a result, it yields inward when axially pressed by the frustoconical inner side of the housing part (13). The one-piece construction of the sealing sleeve (20) from a single material, on the one hand, ensures a simple manufacture and, on the other hand, prevents a faulty mounting caused by slipped seals or the like.

7 Claims, 2 Drawing Sheets

SEALED LAMP SOCKET

CROSS-REFERENCE TO RELATED APPLICATION

This application claims the priority of German Application 10 2005 056 022.9 filed Nov. 24, 2005.

BACKGROUND OF THE INVENTION

The invention relates to a sealed lamp socket for a light means, particularly for fluorescent lamps.

In lamps having an increased degree of protection, dust, moisture or water has to be prevented by suitable means from penetrating into the socket. In particular, the electric connecting device for the lamp contacts has to be protected from moisture and water. This applies independently from the type of the light means. For fluorescent lamps or other bar-like light means to be contacted endwise, generally sockets are used which have a sleeve nut providing a seal at the glass tube of the fluorescent lamp. The sleeve nut is at its inside provided with an appropriate seal.

Such a lamp socket is disclosed, for example, in DE 94 05 817 U1. The socket has a socket housing which comprises a stationary first housing part and a screw arrangement which constitutes a second housing part. The screw arrangement, in turn, comprises a threaded ring, a spacer ring of a socket seal and a tube or lamp seal. Both housing parts enclose an inner chamber in which a connecting device for the contacts of a fluorescent lamp is arranged. Further, in the inner chamber a sealing ring is disposed which has essentially a hollow-cylindrical shape. The sealing ring comprises a rigid ring body, at whose rearward end facing the stationary housing part, an annular groove is formed for receiving a seal therein. On the other hand, the frontal end of the ring body is provided with a seating face which is oriented in the axial direction and on which sharp points are provided. These penetrate into a deformable sealing body. With the sealing body a conical portion of the rotatable housing ring is associated for pressing the sealing ring, when tightened, radially inward against the glass tube of a fluorescent lamp.

It is relatively expensive to manufacture the above-described arrangement. Further, in service, the sealing ring may become detached from the annular carrier which may lead to a faulty mounting. Also, moisture cannot be excluded from seeping through the boundary face between the ring carrier and the sealing ring.

DE 83 10 312 describes a lamp socket for fluorescent lamps, having a screw ring which is to be threaded onto a stationary housing part. The screw ring consists of a rigid, annular plastic body provided with an inner thread. Further, on the socket-side end of the annular body a groove is provided, into which an elastomer material is sprayed for forming a seal. The elastomer material further passes through axial channels of the annular body and, at the lamp-side end of the screw ring, forms a flexible closure. The latter extends radially inward up to an opening through which the lamp tube of the fluorescent lamp may be inserted.

Such a socket ring requires for the lamp tube a narrow-tolerance opening, to ensure that the socket ring can be relatively easily turned with respect to the lamp tube. Tolerances in the tube diameter of the fluorescent lamps, however, pose a problem. While the fluorescent lamps with a small over-size lead to a stiffly turnable screw ring, in case of an under-sizing leaks may appear.

It is accordingly the object of the invention to provide a lamp socket which is easy to manufacture and which may be handled reliably.

SUMMARY OF THE INVENTION

A novel lamp socket finding application with a type of increased protection, has a housing part 13 in which a one-piece elastomer sealing sleeve 20 is preferably rotatably held. The sealing sleeve 20 is at its lamp-side end preferably slightly radially compressible, while it is stiffer in the axial direction. As a result, it yields inward when axially pressed by the frustoconical inner side of the housing part 13. The one-piece construction of the sealing sleeve 20 from a single material, on the one hand, ensures a simple manufacture and, on the other hand, prevents a faulty mounting caused by slipped seals or the like.

The lamp socket according to the invention has a two-part housing, formed of a stationary first housing part and a second housing part to be screwed together with the first housing part. The housing parts enclose an inner space which accommodates the electric connecting means for the fluorescent lamp. Further, a sealing sleeve is provided in the inner space for sealing the latter outward. In the sealing position the sealing sleeve lies firmly against the glass tube of the fluorescent lamp or other discharge lamp, as well as against a sealing face of the first housing part, whereby an outward impervious receiving chamber for the electric connections of the lamp socket is searingly enclosed.

The sealing sleeve has preferably a conical basic shape having a narrower end associated with the lamp tube and a wider end oriented toward the first housing part. The sealing sleeve is preferably flexible in the radial direction. The flexibility is, particularly at the narrower end, of such an extent that the sealing sleeve may be deformed radially inward. In other regions the flexibility may be as large or may be less.

The sealing sleeve is in the axial direction somewhat rigid to such an extent, or at least so rigid that it deforms radially rather than axially if the annular second housing part is screwed tight. The latter then lies against the sealing sleeve with a conical face having the shape of, for example, a 90° cone. When the housing part is screwed tight, this conical pressure face moves axially, while the sealing sleeve yields radially inward.

For increasing the stiffness of the sealing sleeve, the latter may be provided with longitudinal stiffening elements which are preferably externally formed-on, axially extending ribs, consisting of the same material as the sealing sleeve. In the alternative, the sealing sleeve may be provided with bar-like, longitudinally arranged plastic or metal inserts. Forming the longitudinal stiffening elements as longitudinal ribs is, however, considered as being particularly advantageous because of their simple manufacture.

The sealing sleeve has at the inside, at least at its lamp-side forward end, a preferably smooth wall which is formed, for example, of a frustoconical surface. By virtue of the flexibility of the sealing sleeve, the latter fits to different lamp diameters.

Further, the sealing sleeve is provided preferably at both ends with a respective annular rib. The latter provides for a certain stiffening of the respective rim of the sealing sleeve which enhances the sealing effect. The sealing face associated with the housing is preferably a planar annular surface, while the sealing face associated with the lamp is formed by the rim of the conical wall.

Apart from the two endwise annular ribs, the sealing sleeve may be provided with a radially projecting flange with which an annular rib of the second housing part is associated. The latter serves for holding the sealing sleeve in the second housing part even if the second housing part is unscrewed from the first housing part.

The connecting device, disposed in the socket housing and contacting, for example, the contact prongs of a fluorescent lamp, is held in the socket with a substantial play. This makes possible a stress-free support of the fluorescent lamp. The radial orientation is defined by the second housing part, that is, by the sealing sleeve, but not by the connecting device. The connecting device preferably has lateral introduction slots, that is, it is a rotor-less socket. This is possible based on a rotary uncoupling of the second housing part and the sealing sleeve. Since a co-rotation of the fluorescent lamp during screw-tightening of the second housing part may be substantially securely prevented, the fluorescent lamp does not have to be held firmly with respect to the connecting device during the screw-tightening.

In the alternative, rotary sockets may be provided. The non-rotary socket, as well as the rotary socket is preferably formed as a complete structural unit which may be immobilized in the inner space of the socket housing by a detent connection. In case of unitary detent profiles, it is feasible to utilize alternatively rotor-less sockets or rotary sockets in one and the same socket housing.

BRIEF DESCRIPTION OF THE DRAWINGS

For a better understanding of the invention reference may be made to the accompanying exemplary embodiments of the invention illustrated in the drawings, in which.

DESCRIPTION OF THE PREFERRED EMBODIMENTS

Figure 1:
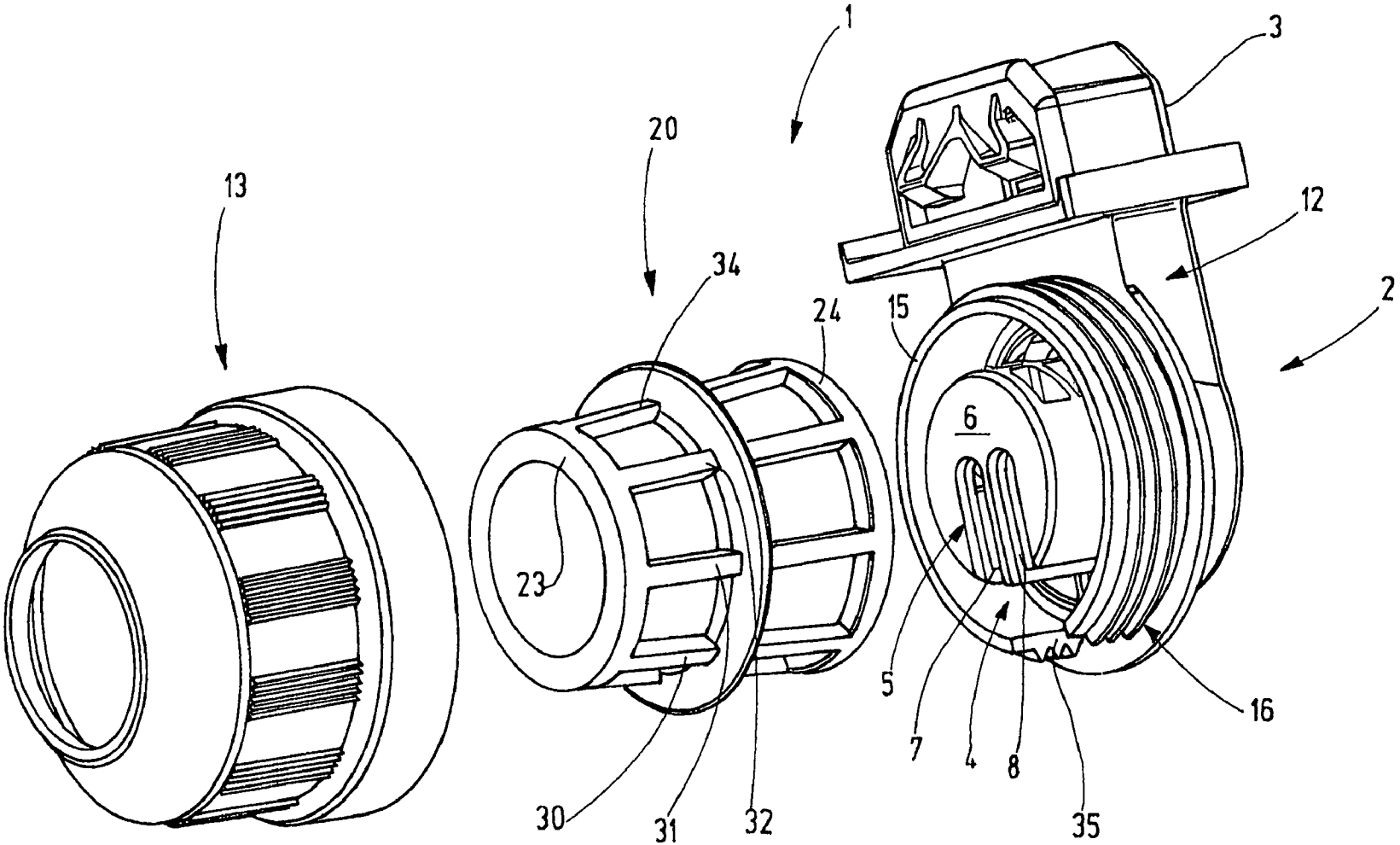
FIG. 1 is an exploded perspective view of the lamp socket according to the invention.
Figure 2:
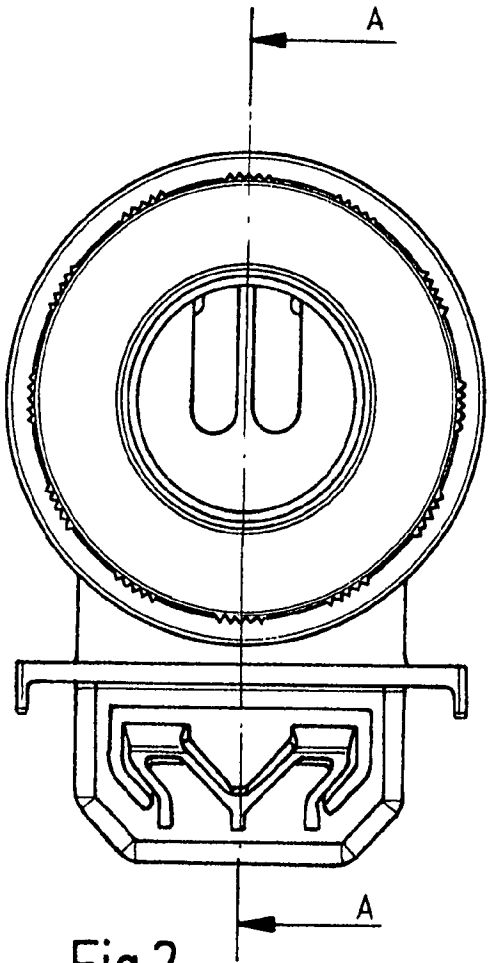
FIG. 2 is a front elevation of the lamp socket according to FIG. 1; and, FIG. 3 is a longitudinal sectional side elevation of the lamp socket according to FIGS. 1 and 2.

FIG. 1 shows a lamp socket 1, whose socket housing 2 has a foot 3 for mounting at or on a lamp carrier, and encloses an inner space 4 in which a connecting device 5 illustrated in FIG. 2 is accommodated. The connecting device 5 serves for supporting and contacting terminal prongs of a fluorescent lamp. The connecting device 5 is held in the socket housing 2 with a lateral play. It is resiliently supported to compensate for longitudinal tolerances of the fluorescent lamp. A "radial" play of the fluorescent lamp is thereby prevented.

The connecting device 5 comprises a partial housing 6 which has two insertion slots 7, 8 for the terminal prongs of the fluorescent lamp. In the end regions of the insertion slots 7, 8 contacts are arranged which serve for supporting the terminal prongs of the fluorescent lamp and for maintaining an electric contact therewith.

Figure 3:
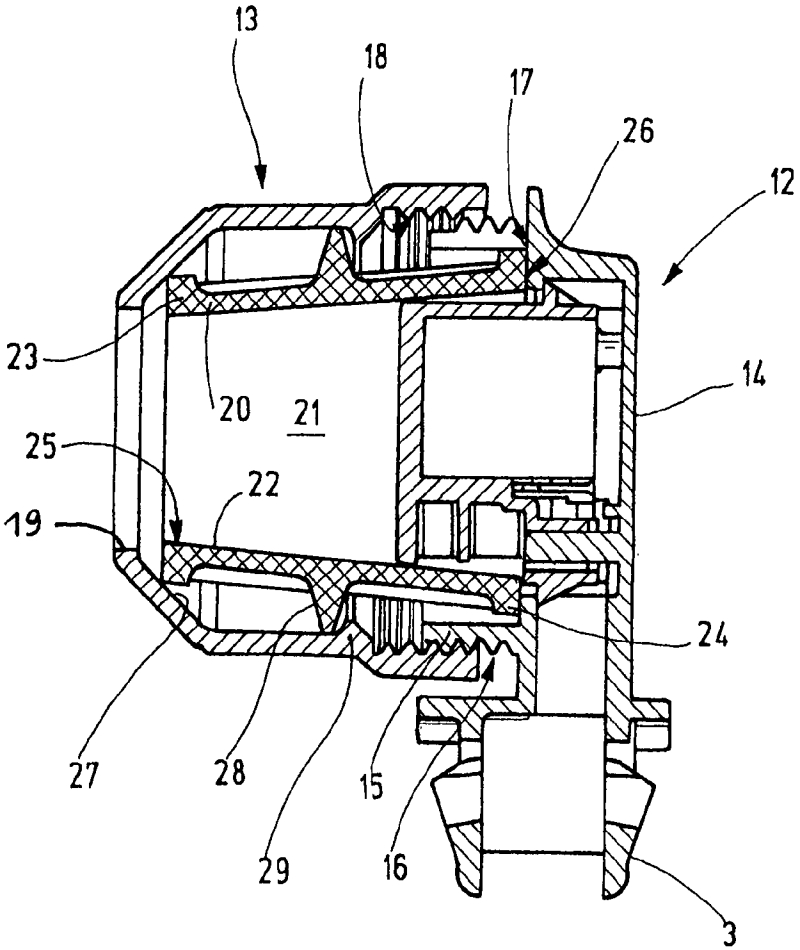

As may be seen in FIG. 1, the socket housing 2 is a multi-part component. The socket housing 2 comprises a first, stationary housing part 12 attached to the foot 3 and a second housing part 13 screwed to the first housing part 12. The latter serves for receiving and supporting the housing part 6 of the connecting device 5. At its side oriented away from the lamp, the housing part 12 is provided with a closed rear wall 14, as shown in FIG. 3. At its oppositely located side, the housing part 12 has, if required, a once or several times slotted tubular extension 15 which is provided with an outer thread 16 at its outer circumference. Immediately radially inward, adjoining the extension 15, on the housing part 12 an annular, uninterrupted planar sealing surface 17 is formed. Within the region bordered by the sealing surface 17, the housing part 12 has, with the exception of a coupling opening at or in the foot 3, no other openings of any kind.

The second housing part 13 is annular and is provided with an inner thread 18. The second housing part 13 has a cylindrical portion which adjoins the portion provided with the inner thread 18 and which is knurled at the outside for forming a grip. To this part a hollow conical portion is adjoined which tapers toward a through passage 19.

In the second housing part 13 a sealing sleeve 20 is arranged which is a one-piece elastomer component, preferably of silicone rubber. It has, as seen in FIG. 3, a tubular basic shape tapering toward one end and surrounding a passage 21 bordered by a frustoconical wall 22. At both ends, the sealing sleeve 20 is provided at its rims with a respective annular rib 23, 24 which stiffens the respective rim. The two ribs 23, 24 preferably have an approximately rectangular cross section. The rib 23 has at its radially inward lying side a sealing zone 25, while the rib 24 has at its end face a planar sealing zone 26 which lies against the sealing face 17. On the other hand, the rib 23 lies against the conical inner side 27 of the frontal portion of the housing part 13. The conical inner side 27 is inclined preferably at 45°.

Further, the sealing sleeve 20 is, approximately centrally, provided with a radial flange 28 formed as a one-piece component with the sealing sleeve 20. The radial flange 28 is associated with a rib 29 extending inward from the housing part 13. In this manner the sealing sleeve 20 is held between the inside 27 and the rib 29 with a slight axial and radial play.

For an axial stiffening, the sealing sleeve 20 is provided with longitudinally extending ribs 30, 31, 32, 33, 34, each extending along the entire length of the sealing sleeve 20 from the rib 23 to the rib 24. The longitudinal ribs 30 to 34 are arranged at equal distances to one another and serve for the stiffening of the sealing sleeve in the longitudinal direction.

The lamp socket 1 described up to this point operates as follows:

For contacting a fluorescent lamp, first the socket part 13 is, together with the sealing sleeve 20 disposed therein, pushed over the rod-like lamp tube, not shown. During such a step, the sealing sleeve 20 slides on the tube. The sealing sleeve 20 is preferably slightly oversized with respect to the tube, that is, it has at its frontal rim a slightly greater inner diameter than the tube. The freely exposed contact prongs of the fluorescent lamp are then introduced into the open socket housing 2. For facilitating this step, an insertion slot 35 may be provided which interrupts the extension 15 at its side remote from the foot 3. The insertion slot 35 thus extends in the axial direction on the upper side of the extension 15.

After the contact prongs of the fluorescent lamp are introduced into the connecting device 5 through the insertion slots 7, 8, the housing part 13 is axially pushed on the housing part 12 to such an extent until its inner thread 18 enters into engagement with the outer thread 16 of the extension 15. Then the housing part 13 is screwed tight onto the housing part 12, while the sealing sleeve 20 may co-rotate. This step is continued until the housing part 13 presses, with the inner side 27, the sealing sleeve 20 axially against the sealing face 17. During this occurrence, the sealing sleeve 20 presses with its rib 23 against the inside 27 of the housing part 13, whereby a radially inward directed force is imparted on the rib 23. As shown particularly in FIG. 3, in this manner the sealing sleeve 20 is pressed, on the one hand, against the sealing face 17 and, on the other hand, against the lamp tube. In this manner an outward sealed space is formed which surrounds the contacting device 5 and into which neither moisture nor dust can penetrate from the outside.

The disassembly is performed by disengaging the housing part 13, whereby the rib 29 eventually entrails axially the sealing sleeve 20 which is held captive in the housing part 13. When the housing part 13 is disengaged, the sealing sleeve 20 too, is easily shift able on the lamp tube.

A novel lamp socket finding application with a type of increased protection, has a housing part 13 in which a one-piece elastomer sealing sleeve 20 is preferably rotatably held. The sealing sleeve 20 is at its lamp-side end preferably slightly radially compressible, while it is stiffer in the axial direction. As a result, it yields inward when axially pressed by the frustoconical inner side of the housing part 13. The one-piece construction from a single material, on the one hand, ensures a simple manufacture and, on the other hand, prevents a faulty mounting caused by slipped seals or the like.

What is claimed is:

1. A lamp socket (1) for a light means, particularly for fluorescent lamps, comprising a socket housing (2) including a stationary first housing part (12) and a second housing part (13) which may be screwed together with the first housing part (12); the first and second housing parts (12, 13) enclose an inner space (4) in which a connecting device (5) is accommodated and a throughout one-piece, flexible sealing sleeve (20), the sleeve (20) has a conical basic shape, the sleeve (20) has a narrow end and a wider end, the sleeve (20) has an interior passage (21) surrounded by an interior frustoconical wall (22), the sleeve 20 which at the wider end is provided with an axial sealing face (26) associated with a sealing face (17) of the socket housing (2) and which at the narrow end, the frustoconical wall (22) has a face portion which is provided with a radial sealing face (25) which is associated with the light means, the sleeve (20) includes longitudinal elements (30, 31, 32, 33, 34) for stiffening the seal sleeve (20) in the longitudinal direction, the sealing sleeve (20) is provided with a projection (28) at its outer circumference, the projection 28 is associated with the longitudinal elements (30, 31, 32, 33, 34) for stiffening the seal sleeve (20) in the longitudinal direction;

wherein the sealing sleeve is provided at both ends with at least one respective annular rib;

wherein the projection is a radial flange;

wherein the second housing part includes an inward facing rib which is in engagement with the radial flange.

2. The lamp socket of claim 1, wherein the sealing sleeve (20) is radially flexible.

3. The lamp socket of claim 1, wherein the sealing sleeve (20) is axially stiff.

4. The lamp socket of claim 1, wherein the axial sealing face (26) is a planar annular face.

5. The lamp socket of claim 1, wherein the longitudinal elements (30, 31, 32, 33, 34) are longitudinal ribs arranged at the outer circumference, of the sealing sleeve (20).

6. The lamp socket of claim 1, wherein the sealing sleeve (20) is an elastomer.

7. The lamp socket of claim 1, wherein the sealing sleeve (20) is a silicone rubber.

* * * * *